US009875843B2

(12) United States Patent
Fan et al.

(10) Patent No.: US 9,875,843 B2
(45) Date of Patent: Jan. 23, 2018

(54) ELECTRIC COIL DEVICE

(71) Applicant: BOTHHAND ENTERPRISE INC., Tainan (TW)

(72) Inventors: Chung-Cheng Fan, Taoyuan (TW); Yung-Ming Pan, Taoyuan (TW)

(73) Assignee: BOTHHAND ENTERPRISE INC., Tainan (TW)

( * ) Notice: Subject to any disclaimer, the term of this patent is extended or adjusted under 35 U.S.C. 154(b) by 315 days.

(21) Appl. No.: 14/885,529

(22) Filed: Oct. 16, 2015

(65) Prior Publication Data

US 2016/0329147 A1 Nov. 10, 2016

(30) Foreign Application Priority Data

May 6, 2015 (TW) ..... 104114447 A

(51) Int. Cl.

| | |
|---|---|
| ***H01F 27/28*** | (2006.01) |
| ***H01F 17/04*** | (2006.01) |
| ***H01F 27/29*** | (2006.01) |
| ***H01F 27/40*** | (2006.01) |
| *H01F 17/00* | (2006.01) |

(52) U.S. Cl.

CPC ..... *H01F 27/29* (2013.01); *H01F 27/2823* (2013.01); *H01F 27/40* (2013.01); *H01F 2017/0093* (2013.01)

(58) Field of Classification Search

USPC ..... 336/188, 220, 211, 221, 229

See application file for complete search history.

(56) References Cited

U.S. PATENT DOCUMENTS

| | | | | |
|---|---|---|---|---|
| 3,473,091 | A * | 10/1969 | McDonald | H02H 3/17 361/45 |
| 4,631,504 | A * | 12/1986 | Matsuda | H03H 7/42 333/25 |
| 5,140,706 | A * | 8/1992 | Maeda | H01F 27/027 336/192 |
| 8,576,037 | B1 * | 11/2013 | Ji | H01F 30/04 336/148 |
| 2006/0132276 | A1 * | 6/2006 | Harding | H01F 17/0006 336/229 |
| 2012/0146755 | A1 * | 6/2012 | Shao | H01F 17/062 336/182 |
| 2014/0232505 | A1 * | 8/2014 | Ueno | H01F 17/062 336/212 |

* cited by examiner

*Primary Examiner* — Elvin G Enad
*Assistant Examiner* — Kazi Hossain
(74) *Attorney, Agent, or Firm* — Muncy, Geissler, Olds & Lowe, P.C.

(57) ABSTRACT

An electric coil device includes a terminal unit and a coil module. The terminal unit includes a block and multiple terminals. The coil module is mounted to the block and includes first and second winding cores, two first wires and two second wires. Each of the first wires has a transformer wire segment wound on the first winding core, and an inductor wire segment wound on the second winding core. The transformer wire segment of each of the first wires is electrically connected to a respective one of the terminals, and the inductor wire segment of each of the first wires is electrically connected to the respective one of the terminals, thereby achieving the functions of a transformer and a common-mode choke.

8 Claims, 5 Drawing Sheets

ELECTRIC COIL DEVICE

CROSS-REFERENCE TO RELATED APPLICATION

This application claims priority of Taiwanese Patent Application No. 104114447, filed on May 6, 2015.

FIELD

The disclosure relates to an electric coil device, more particularly to an electric coil device having the functions of a transformer and a common-mode choke.

BACKGROUND

A conventional electric coil device is designed to include multiple coil modules that are mounted to a block for achieving the functions of a transformer and an electronic filter. Each coil module includes two winding cores and four wires. The four wires are wound on one of the winding cores for achieving the function of a transformer. Two of the four wires are further wound on the other of the winding cores for achieving the function of a common-mode choke.

However, the structure of the two wires respectively wound on winding cores that provide dual functions of both a transformer and a common-mode choke is formed by first winding one of the wires on a corresponding one of the winding cores, followed by winding the other of the wires on the remaining one of the winding cores. This is due to difficulty or inconvenience in simultaneous winding of the two wires on the winding cores, and results in a slow and tedious winding process.

SUMMARY

Therefore, an object of the present disclosure is to provide an electric coil device that can alleviate the aforementioned drawback associated with the conventional electric coil device.

According to an aspect of the present disclosure, an electric coil device includes a terminal unit and at least one coil module. The terminal unit includes a block, and two first terminals, two connection terminals, a first grounding terminal, two second terminals and a second grounding terminal that are mounted to the block. The at least one coil module is mounted to the block, and includes a first winding core, a second winding core, two first wires and two second wires. Each of the first wires has a transformer wire segment wound on the first winding core, and an inductor wire segment wound on the second winding core. The transformer wire segment of each of the first wires is electrically connected to a respective one of the connection terminals, and is electrically connected to the first grounding terminal. The inductor wire segment of each of the first wires is electrically connected to a respective one of the connection terminals, and is electrically connected to a respective one of the first terminals. The second wires are wound one the first winding core. Each of the second wires is electrically connected to a respective one of the second terminals, and is electrically connected to the second grounding terminal.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
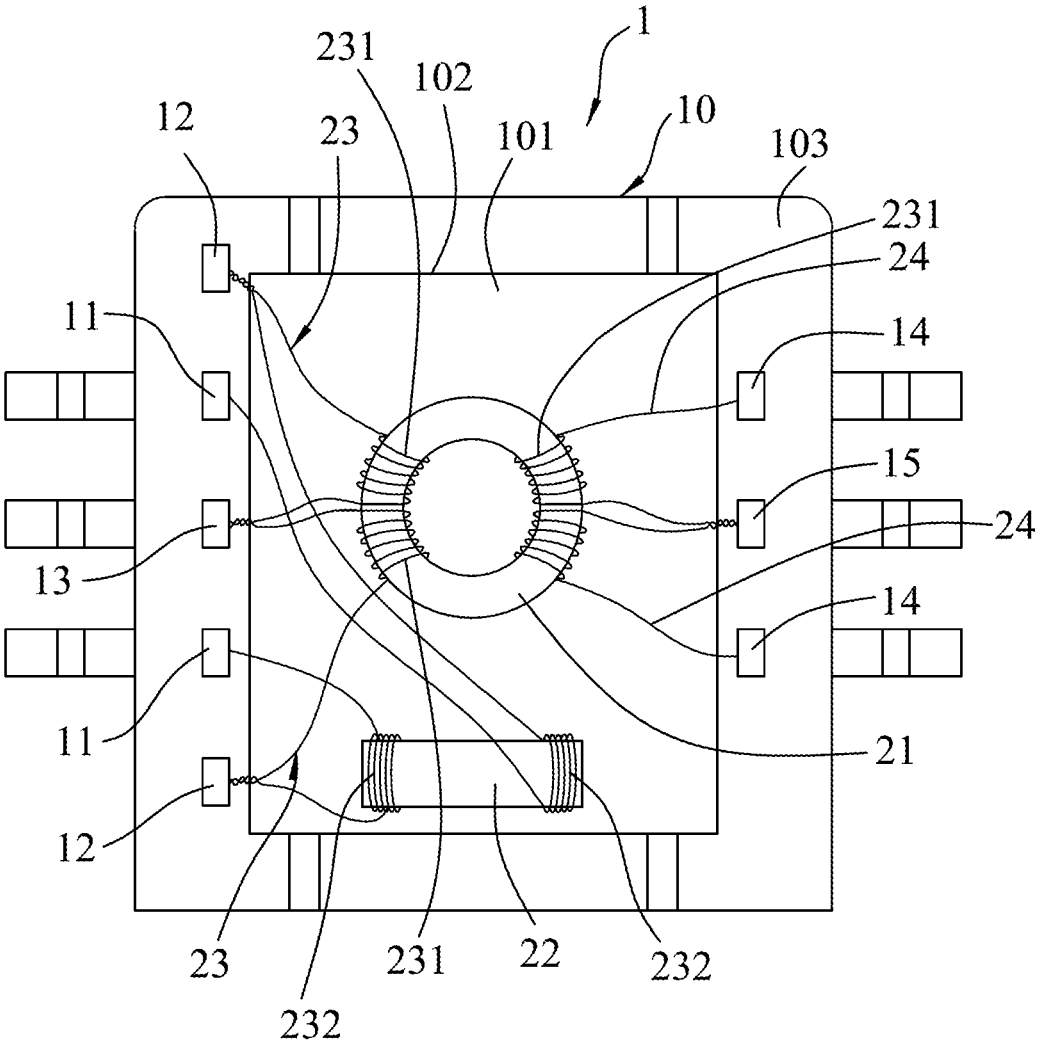
FIG. 1 is a top view of a first embodiment of an electric coil device according to the present disclosure.

Before the disclosure is described in further detail with reference to the accompanying embodiments, it should be noted herein that like elements are denoted by the same reference numerals throughout the disclosure.

Figure 2:
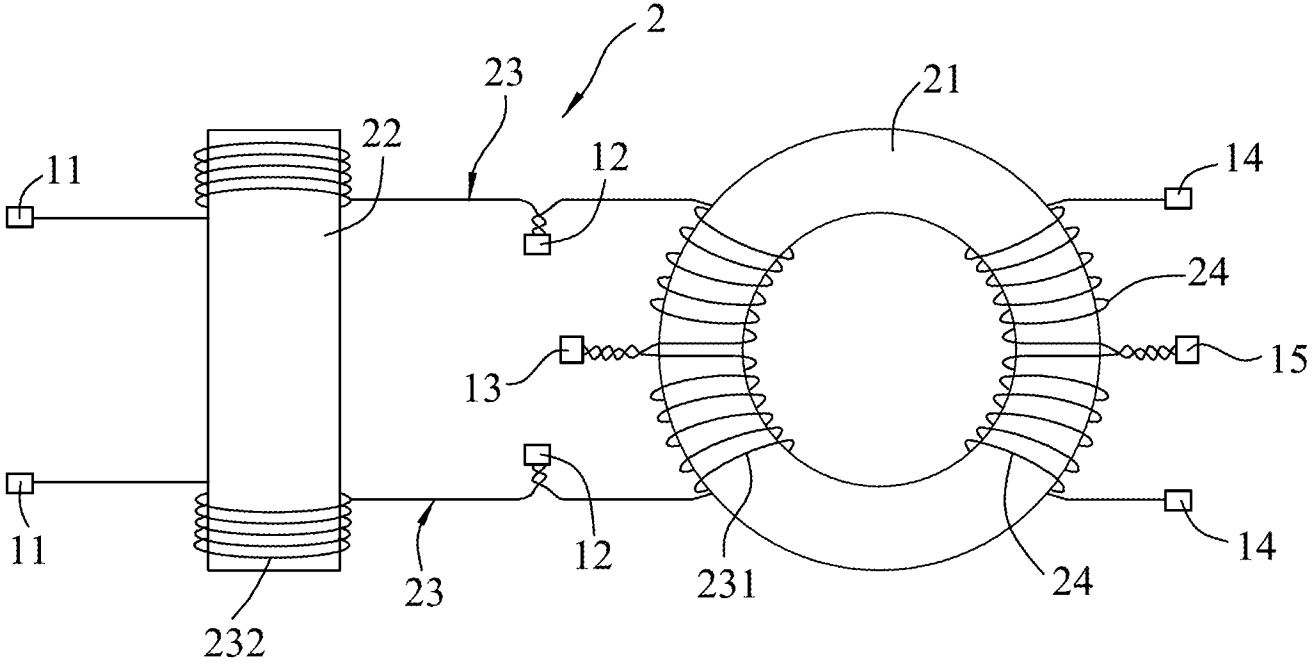
FIG. 2 is a schematic view showing the wiring of the first embodiment.

Referring to FIGS. 1 and 2, a first embodiment of an electric coil device according to the present disclosure includes a terminal unit 1 and a coil module 2. The terminal unit 1 includes a block 10 that has a base wall 101 and a surrounding wall 103 projecting from the base wall 101 and cooperating with the base wall 101 to define a receiving space 102. The terminal unit 1 further includes two first terminals 11, two connection terminals 12, a first grounding terminal 13, two second terminals 14 and a second grounding terminal 15 that are mounted to the block 10 and project from the surrounding wall 103.

The coil module 2 is mounted in the receiving space 102 of the block 10, and includes a first winding core 21, a second winding core 22, two first wires 23 and two second wires 24. Each of the first and second winding cores 21, 22 is ring-shaped. Each of the first wires 23 has a transformer wire segment 231 wound on the first winding core 21, and an inductor wire segment 232 wound on the second winding core 22.

Each of the transformer wire segment 231 and the inductor wire segment 232 of each of the wires 23 has two opposite ends. One of the ends of the transformer wire segment 231 and a respective one of the ends of the inductor wire segment 232 of each of the wires 23 are entwined with each other and are electrically connected to a respective one of the connection terminals 12. The other ends of the transformer wire segments 231 of the wires 23 are entwined with each other and are electrically connected to the first grounding terminal 13. The other end of the inductor wire segment 232 of each of the wires 23 is electrically connected to a respective one of the first terminals 11. Each of the second wires 24 has two opposite ends, one of which is electrically connected to a respective one of the second terminals 14. The other ends of the second wires 24 are entwined with each other and are electrically connected to the second grounding terminal 15.

In assembling the first embodiment of the electric coil device, a worker winds the transformer wire segments 231 of the first wires 23 on the first winding core 21, while another worker simultaneously winds the inductor wire segments 232 of the first wires 23 on the second winding core 22. The second wires 24 are also wound on the first winding core 21. The other ends of the transformer wire segments 231 of the wires 23 are entwined with each other, and the other ends of the second wires 24 are entwined with each other. The coil module 2 is then mounted in the receiving space 102 of the block 10. Afterwards, the one end of the transformer wire segment 231 and the respective end of the inductor wire segment 232 of each of the wires 23 are entwined with each other and are electrically connected to the respective one of the connection terminals 12. The other end of the inductor wire segment 232 of each of the wires 23 is electrically connected to the respective one of the first terminals 11. The entwined other ends of the transformer wire segments 231 of the wires 23 are electrically connected to the first grounding terminal 13. The one end of each of the second wires 24 is electrically connected to the respective one of the second terminals 14. The entwined other ends of the second wires 24 are electrically connected to the second grounding terminal 15. Tin welding process may be applied to the terminals for the purpose of fixing the wires to the corresponding terminals.

Generally, wires are provided with plastic insulation sheaths. Each wire is provided with a sheath of a specific color so as to be distinguishable from other wires . In this embodiment, the first wires 23 may be provided with red and blue sheaths, and the second wires 24 may be provided with green and gold sheaths. Therefore, in assembling the electric coil device, workers can easily distinguish the first wires 23 from the second wires 24.

Figure 3:
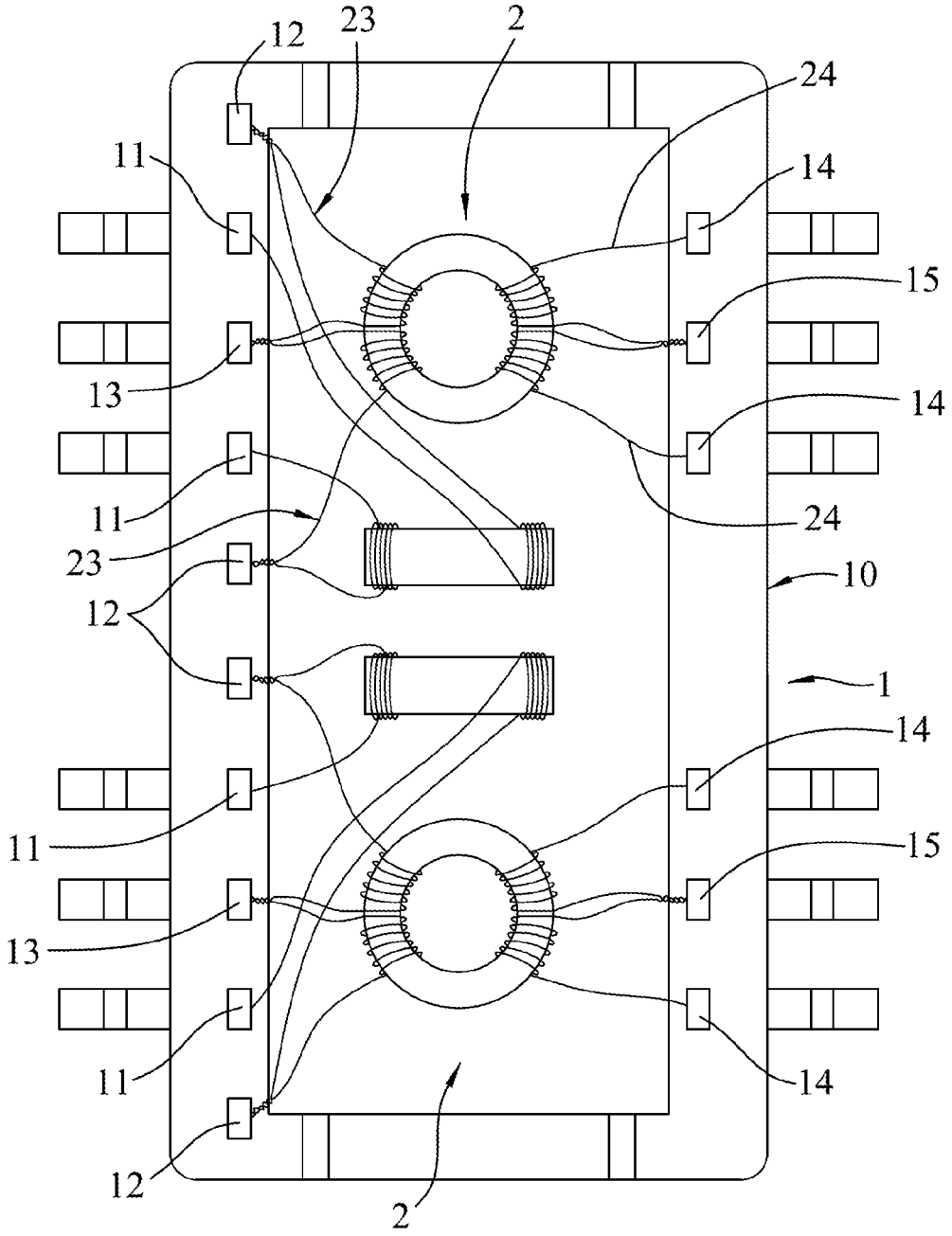
FIG. 3 is a top view of a second embodiment of the electric coil device according to the present disclosure.

Referring to FIG. 3, a second embodiment of the electric coil device according to the present disclosure is similar to the first embodiment. The differences reside in that the second embodiment of the electric coil device includes two coil modules and the numbers of the terminals are doubled. That is, in the second embodiment, the terminal unit 1 includes the block 10, four first terminals 11, four connection terminals 12, two first grounding terminals 13, four second terminals 14 and two second grounding terminals 15. The manner of connection in the second embodiment is similar to that of the first embodiment, and will not be described herein for the sake of brevity.

Figure 4:
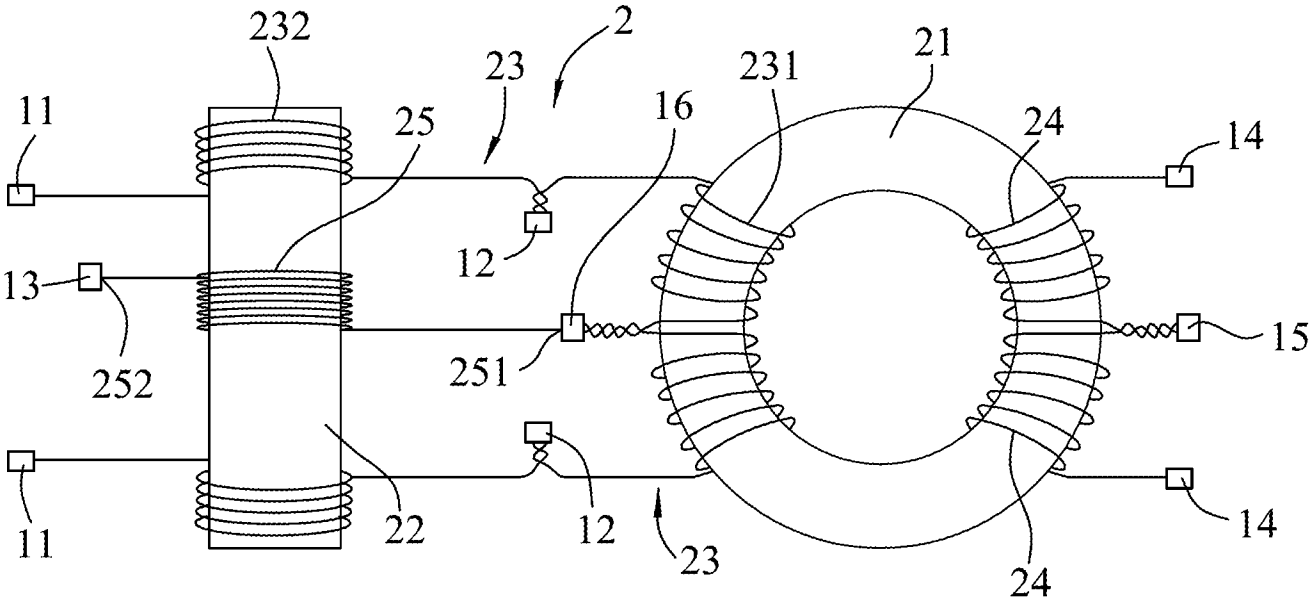
FIG. 4 is a schematic view showing the wiring of the second embodiment.
Figure 5:
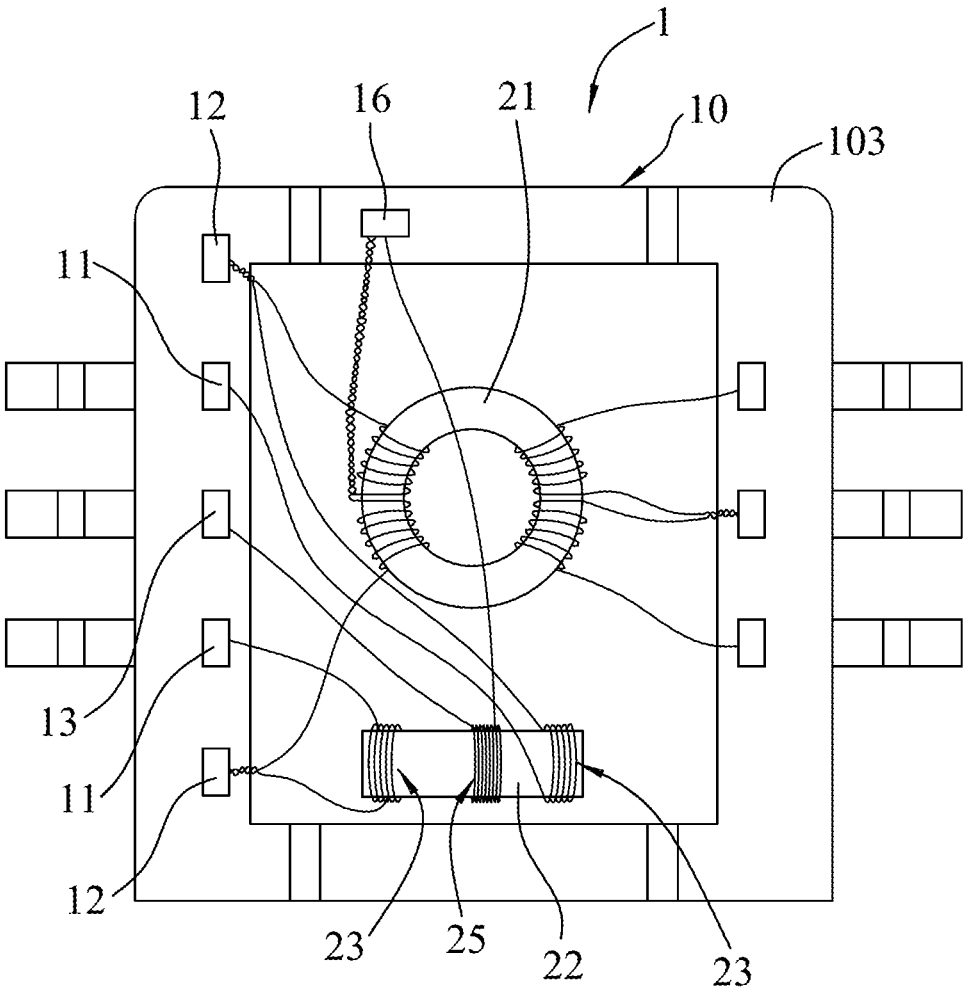
FIG. 5 is a top view of a third embodiment of the electric coil device according to the present disclosure.

Referring to FIGS. 4 and 5, a third embodiment of the electric coil device according to the present disclosure is similar to the first embodiment with the differences being described in the following. In the first embodiment, each of the first wires 23 is electrically and directly connected to the first grounding terminal 13. However, in the third embodiment, each of the first wires 23 is electrically and indirectly connected to the first grounding terminal 13. The terminal unit 1 in the third embodiment further includes a third grounding terminal 16 mounted to the block 10 and project from the surrounding wall 103. The entwined other ends of the transformer wire segments 231 of the wires 23 are electrically and directly connected to the third grounding terminal 16. The coil module 2 further includes a grounding wire 25 wound on the second winding core 22, and having two ends 251, 252 that are respectively and electrically connected to the third grounding terminal 16 and the first grounding terminal 13. In other words, the grounding wire 25 electrically interconnects the third grounding terminal 16 and the first grounding terminal 13. In assembling the third embodiment of the electric coil device, the inductor wire segments 232 of the first wires 23 and the grounding wire 25 are simultaneously wound on the second winding core 22, and the transformer wire segments 231 of the wires 23 and the second wires 24 are wound on the first winding core 21. Then, the wires are electrically connected to the terminal unit 1 in the manner described above for achieving dual functions of both a transformer and a common-mode choke.

To sum up, with each of the first wires 23 having the transformer wire segment 231 and the inductor wire segment 232, simultaneous winding of the transformer wire segment 231 and the inductor wire segment 232 on the first winding core 21 and the second winding core 22, respectively, becomes feasible, thereby improving assembling efficiency.

While the disclosure has been described in connection with what are considered the embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An electric coil device, comprising:

a terminal unit including a block, and two first terminals, two connection terminals, a first grounding terminal, two second terminals and a second grounding terminal that are mounted to said block; and at least one coil module mounted to said block, said at least one coil module including a first winding core, a second winding core, two first wires, each of which has a transformer wire segment wound on said first winding core, and an inductor wire segment wound on said second winding core, said transformer wire segment of each of said first wires being electrically connected to a respective one of said connection terminals, and being electrically connected to said first grounding terminal, said inductor wire segment of each of said first wires being electrically connected to a respective one of said connection terminals, and being electrically connected to a respective one of said first terminals, and two second wires wound on said first winding core, each of said second wires being electrically connected to a respective one of said second terminals, and being electrically connected to said second grounding terminal.

2. The electric coil device as claimed in claim 1, wherein said transformer wire segment of each of said first wires is electrically and indirectly connected to said first grounding terminal.

3. The electric coil device as claimed in claim 2, wherein:

said terminal unit further includes a third grounding terminal mounted to said block;

said at least one coil module further includes at least one grounding wire wound on said second winding core;

said transformer wire segment of each of said first wires being electrically connected to said third grounding terminal; and said at least one grounding wire electrically interconnects said third grounding terminal and said first grounding terminal.

4. The electric coil device as claimed in claim 3, wherein said transformer wire segment and said inductor wire segment of each of said first wires are entwined with each other and are electrically connected to a respective one of said connection terminals.

5. The electric coil device as claimed in claim 1, wherein said transformer wire segment of each of said first wires is electrically and directly connected to said first grounding terminal.

6. The electric coil device as claimed in claim 5, wherein said transformer wire segment and said inductor wire segment of each of said first wires are entwined with each other and are electrically connected to a respective one of said connection terminals.

7. The electric coil device as claimed in claim 2, wherein said transformer wire segment and said inductor wire segment of each of said first wires are entwined with each other and are electrically connected to a respective one of said connection terminals.

8. The electric coil device as claimed in claim 1, wherein said transformer wire segment and said inductor wire segment of each of said first wires are entwined with each other and are electrically connected to a respective one of said connection terminals.

* * * * *